US008373098B2

(12) United States Patent
Johnson

(10) Patent No.: US 8,373,098 B2
(45) Date of Patent: Feb. 12, 2013

(54) OVEN APPLIANCE CLEANING SYSTEM USING HEAT AND STEAM CYCLE

(75) Inventor: Eric Scott Johnson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 119 days.

(21) Appl. No.: 12/966,247

(22) Filed: Dec. 13, 2010

(65) Prior Publication Data

US 2012/0145696 A1 Jun. 14, 2012

(51) Int. Cl.
*A21B 1/22* (2006.01)
*F24D 1/00* (2006.01)

(52) U.S. Cl. ..... 219/401; 219/400; 219/402; 219/391; 219/407; 392/394; 392/397; 392/398; 126/369; 126/369.1; 134/19

(58) Field of Classification Search ..... 219/401, 219/400, 402, 391, 407; 392/394, 397–8; 126/369, 369.1; 134/19
See application file for complete search history.

(56) References Cited

U.S. PATENT DOCUMENTS

| | | | |
|---|---|---|---|
| 6,878,910 | B2 | 4/2005 | Kim et al. |
| 6,909,071 | B2 | 6/2005 | Shozo |
| 7,234,478 | B2 | 6/2007 | Kanzaki et al. |
| 7,326,891 | B2 | 2/2008 | Sung et al. |
| 2004/0094540 | A1 | 5/2004 | Cherry |
| 2004/0094542 | A1 | 5/2004 | Kim et al. |
| 2005/0022676 | A1 | 2/2005 | Swank et al. |

FOREIGN PATENT DOCUMENTS

| | | | |
|---|---|---|---|
| EP | 1557612 | * | 7/2005 |
| WO | WO 2008/044844 | | 4/2008 |
| WO | WO 2008/044866 | | 4/2008 |

* cited by examiner

*Primary Examiner* — Shawntina Fuqua
(74) *Attorney, Agent, or Firm* — Dority & Manning, P.A.

(57) ABSTRACT

A system for cleaning the interior surface of an oven appliance using heat and steam cycles is provided. More particularly, the present invention uses a heat cycle to break down water insoluble food residues into soluble materials that are then cleaned by a steam cycle. Following the steam cycle, the remaining food residues can be removed from the interior surface of the oven appliance.

20 Claims, 4 Drawing Sheets

OVEN APPLIANCE CLEANING SYSTEM USING HEAT AND STEAM CYCLE

FIELD OF THE INVENTION

The present invention relates to a system for cleaning an oven appliance using heat and steam cycles.

BACKGROUND OF THE INVENTION

During the operation of oven appliances, food can sometimes be spilled onto the interior surface of the oven. Food residue can also be deposited onto the interior surface of the oven from spattering caused by the rapid expansion of water or other gases as the food cooks. In addition, the cooking of food releases fumes that can include steam and various gaseous by-products from the cooking process. While some portion of these fumes are removed by venting to the exterior of the appliance, a portion also typically deposits soil onto the interior surface of the oven and can become a food residue that consumers typically want to remove during cleanup.

The food residues deposited onto the interior, particularly from spills or spattering, frequently include grease and sugars. The temperatures used during cooking can bake the grease and sugar onto the interior surface of the oven, which makes cleanup difficult. Sugars in the food can carmelize above 220° F. and lipids can break down to form varnish above 225° F. After the interior surface is soiled with a food, the soil can melt into the pores in the surface and then dehydrate during cooking. Eventually a hardened residue or varnish is formed that is not water soluble. More specifically, while some residues may be removable by a wipe down after oven cooling, the baked on residue from many food sugars and oils is generally not water soluble and therefore cannot be readily removed by washing with water and the detergents commonly kept in kitchen areas.

Chemical cleaners are available for oven cleaning. Such are generally provided as a spray or wipe that is used to dissolve the unsightly residues. However, these cleaners frequently have an odor that consumers may find unpleasant or otherwise objectionable due to the presence of chemicals perceived as hazardous. Certain self-cleaning ovens may even have specially-treated surfaces that can be harmed by chemical cleaners. In addition, intensive manual labor may still be required even with the use of such chemicals in order to remove the residues.

Modern ovens are frequently provided with a self-cleaning cycle. This cycle uses a high temperature (e.g., >800° F.) at an extended period of time (e.g., 3 to 5 hours). If a proper amount of time is provided, the heat generated at such temperatures burns off or incinerates the food residue. Unfortunately, the time and temperature required for operation of the self-cleaning cycle can consume a significant amount of energy that increases operating costs. In addition, the heat generated by the self-cleaning cycle can warm up the kitchen area, which may be undesirable during warmer seasons of the year where the kitchen area is being cooled by air conditioning. If the self-cleaning cycle is not operated at high enough temperature for an appropriate amount of time, the cycle must either be repeated and/or the amount of manual labor still required to remove the residues from the surfaces will be undesirable to the user.

Accordingly, an improved system for the cleaning of an oven appliance would be useful. More particularly, a system for oven cleaning that can more easily remove soils such as water insoluble grease and sugar residues from the interior surface of the oven is desirable. Such a system that can also avoid the use of undesirable chemical cleaners and operate with less energy consumption than a conventional oven self-cleaning cycle would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present invention, a method for cleaning an oven appliance is provided. The oven appliance has at least one cavity defined by an interior surface. The method includes the steps of heating the cavity to a first predetermined temperature and for a period of time that is sufficient to break down food residue on the interior surface of the oven; cooling the oven to a second predetermined temperature; introducing steam into the cavity of the oven; allowing the cavity to cool; and providing a notification to the user that the cavity is ready for further treatment.

In another exemplary embodiment, the present invention provides an oven appliance that includes a cavity defined by an interior surface. A heating element that is capable of bringing the interior of the oven to a temperature that is sufficient to break down food residue. The oven includes a processing device. The processing device is configured to operate the oven by heating the cavity to a first predetermined temperature for a period of time sufficient to break down food residue on the interior surface of the oven; cooling the oven to a second predetermined temperature; initiating the introduction of steam into the cavity of the oven; allowing the cavity to cool; and providing a notification to the user that the cavity is ready for further treatment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
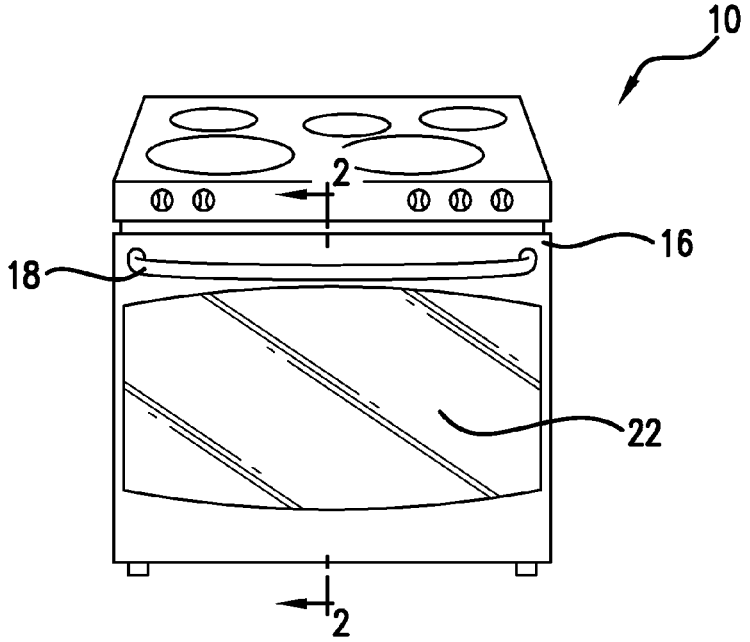
FIG. 1 provides a front view of an exemplary embodiment of an oven according to the present invention.

The present invention provides a system for cleaning the interior surface of an oven appliance using heat and steam cycles. More particularly, the present invention uses a heat cycle to break down water insoluble food residues into soluble materials that are then cleaned by a steam cycle. Following the steam cycle, the remaining food residues can be removed from the interior surface. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of an oven appliance 10 of the present invention. Oven 10 includes an insulated cabinet 12 that includes an interior cooking cavity 14 defined by an interior surface 15 and configured for the receipt of one or more food items to be cooked. Oven 10 includes a door 16 hingedly attached to cabinet 12. Handle 18 allows for access to cavity 14. Seal 20 provides for maintaining heat and cooking fumes within cavity 14 when door 16 is closed as shown in FIG. 1. Glass panes 22 provide for viewing the contents of cavity 14 when door 16 is closed. Rack 24 is positioned in cavity 14 for the receipt of food items. Rack 24 is slidably received onto ribs/rails 26 such that pan 24 may be conveniently moved into and out of cavity 14 when door 16 is open.

A heating element 28 is positioned in cabinet 12 below a recess 30 defined by the interior surface 15. The heating element 28 is used to heat cavity 14 for both cooking and cleaning of oven 10. For this exemplary embodiment of the present invention, a tube 32 is used to feed water into recess 30 for the creation of steam as will be further described below. The flow of such water is controlled by a valve 34. A pump 36 can also be provided to assist in the supply water into cavity 14 where sufficient water pressure is not otherwise available. Water can also be manually provided into recess 30 by the user through e.g., pouring as will be further described below.

The operation of oven 10 including heating element 28, valve 34, and or pump 36 is controlled by one or more processing devices (not shown) such as a microprocessor other device that is in communication with such components. Such processing device is also in communication with a temperature sensor 38 that is used to measure temperature inside cavity 14. As will be further described below, the processing device is configured with one or more cycles for cleaning the interior surface 15 of oven 10.

Although only one temperature sensor 38 is shown, it should be understood that multiple sensors 38 could be placed into oven 10 for determining the oven temperature. As will be understood by one of ordinary skill in the art, the temperature within oven 10 may not be homogeneous during operation and can include regions that are hotter or colder. Accordingly, multiple temperature sensors can be used to more accurately determine oven temperature. In addition, the processing device(s) of oven 10 can be equipped with one on more algorithms for determining oven temperature based on input from multiple temperature sensors.

Figure 2:
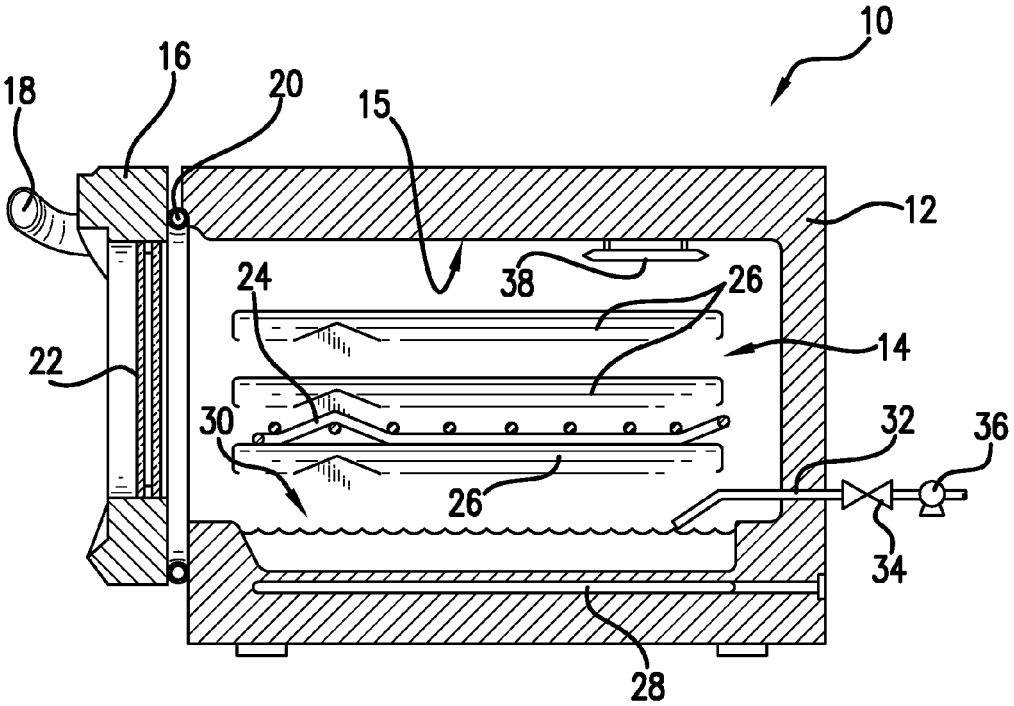
FIG. 2 provides a side, cross-sectional view of the exemplary embodiment of FIG. 1.

Oven 10 is provided by way of example only. The present invention may be used with other oven configurations. For example, the present invention may be used with an oven defining multiple interior cavities for the receipt of food and/or having different pan or rack arrangements than what is shown in FIG. 2. Heating elements at the top, back, or sides of cavity 14 may also be provided. Other configurations may also be used as will be understood by one of skill in the art using the teachings disclosed herein.

During the operation of oven 10, food may spatter during cooking or be spilled from cooking utensils. As a result, due to the operating temperatures of the oven 10, such food eventually becomes a food residue that is cooked onto the interior surface 15 of oven 10. Where such food includes a grease or oil, the resulting food residue is created by e.g., lipids that break down to form varnish on interior surface 15 at temperatures in the range of e.g., about 225° F. to about 520° F. Where such food residue comes from e.g., a sugar, the oven heat can cause carmelization at temperatures in the range of e.g., about 225° F. to about 700° F. Such residues are generally water insoluble and, as previously described, cannot be removed by water based cleaning.

Figure 3:
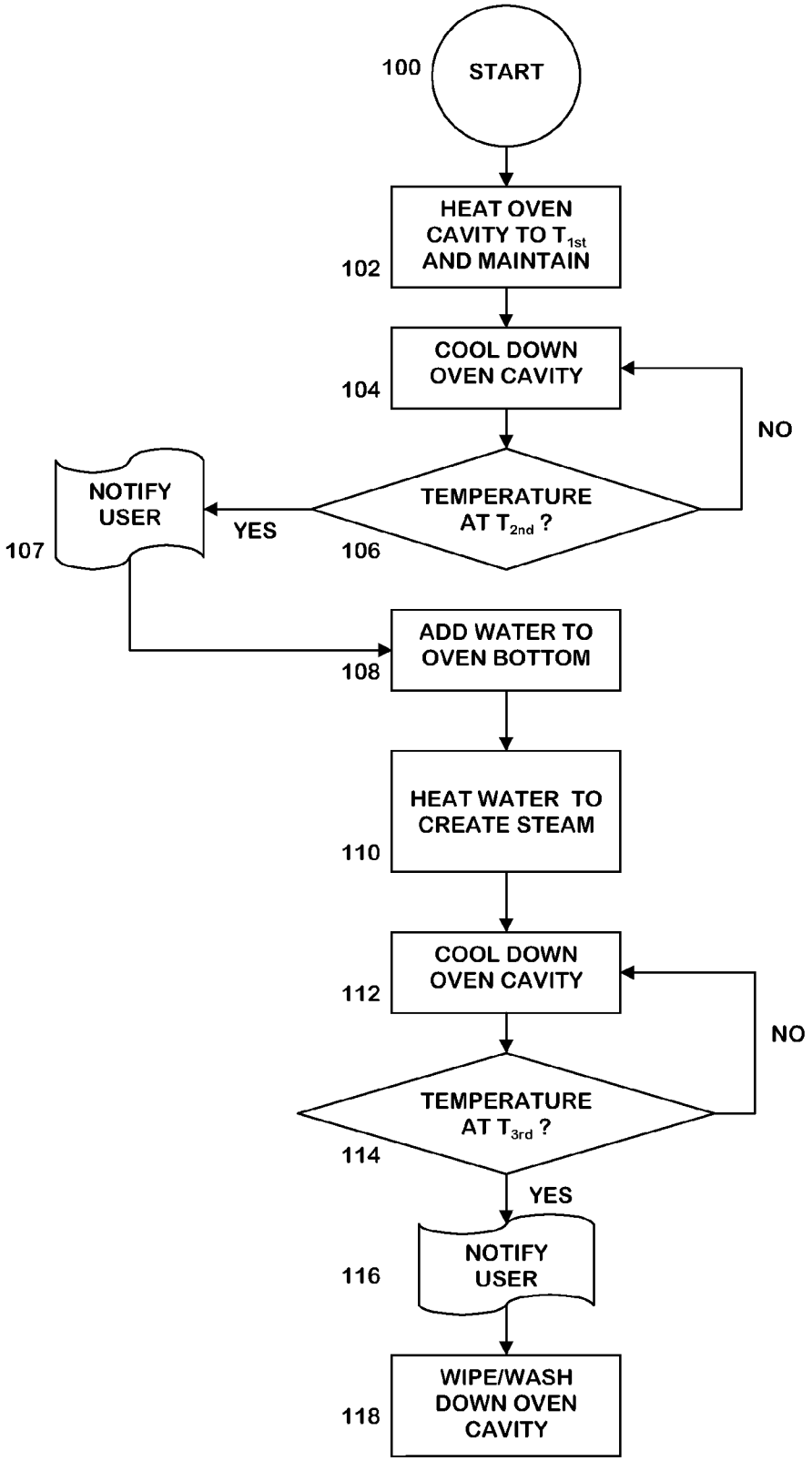
FIGS. 3, 4, and 5 each include a flow chart that illustrates an exemplary method of the present invention.

Accordingly, oven 10 is equipped with a cleaning system for the removal of these otherwise water insoluble residues. More specifically, an exemplary method for operating oven 10 is provided as a flow chart that is illustrated in FIG. 3. The processing device(s) of oven 10 can be, for example, configured to operate oven 10 according to the steps shown in FIG. 3 and as now described.

Beginning with step 100, the user of the appliance starts the cleaning cycles for oven 10. For example, the cleaning cycles could be initiated using a touch pad (not shown) or other controls provided with oven 10. The decision regarding when to begin a cleaning cycle could be left to the user based on inspection of the interior surface 15 of cavity 14. In addition, oven 10 could be configured to signal the user that cleaning is recommended based on a time interval since the last cleaning or the number of uses since the last cleaning.

In step 102, the oven 10 is turned on so as to heat cavity 14 to a first predetermined temperature, $T_{1st}$, and maintain that temperature within a specified range for a period of time. The precise temperature $T_{1st}$ and duration for step 102 depends on the size of oven 10, the overall interval of time in which it is desired for oven 10 to complete the cleaning cycles of FIG. 3, and the type of food residues present. Regardless, the temperature and time applied in step 102 are selected so as to provide for the break down of water insoluble portions of the food residue on the interior surface of the oven such that, after step 102, the food residue becomes more water soluble. For example, at temperatures above 700° F., the heat begins to break down water insoluble greases (e.g., lipids) and sugars and converts such into components that are more water soluble. Higher temperatures, such as e.g., 800° F. or higher may also be used in order to shorten the amount of time required for step 102.

Unlike the lengthy time period required for a conventional oven operating a self-cleaning cycle, the time used for step 102 is not of a duration that fully incinerates all of the food residue on interior surface 15. Instead, the duration used for step 102 is one that will break down water insoluble food residues on interior surface 15 and convert the same into components that are more water soluble. Because step 102 will be generally shorter than a conventional self-clean oven cycle, a savings in energy usage can be achieved.

After step 102, cavity 14 is allowed to cool down to a second predetermined temperature, $T_{2nd}$, in step 106. The cool down allows the interior surface 15 of oven 10 to reach a temperature suitable for contact by the user and for the condensation of steam to be introduced in a later step. The cooling of cavity 14 can be allowed to occur by natural conduction and convection or, alternatively, a fan such as the fan used for convection cooking may be used to circulate air through cavity 14 and/or exhaust air to the exterior of oven 10. As indicated at 106, temperature sensor 38 provides temperature measurements to e.g., the processing device, which in turn determines when cavity 14 has reached or cooled below $T_{2nd}$. As an alternative to step 106, a timer or time delay could be provided that would allow the cavity 14 sufficient time to cool to or below $T_{3rd}$ or temperature appropriate for the user to open door 16.

Once cavity 14 has cooled to $T_{2nd}$ in step 107 the user is notified that oven 10 has properly cooled. The user then opens door 16 in step 108 and adds water into the recess 30 formed by the interior surface 15 of cavity 14. Recess 30 is a relatively small reservoir that serves to hold the water for steam generation. The amount of water added depends e.g., on the size of oven 10 and the amount of steam needed to clean interior surface 15. Upon adding the appropriate amount of water, the user then closes door 16 and may also press a button or respond to a prompt so as to indicate to the processing device that water has been placed into recess 30.

In the next cycle of cleaning, heating element 28 is activated to heat the water in recess 30 and generate steam (step 110 of FIG. 3). As the steam rises from recess 30, it spreads through-out cavity 14, eventually contacts the now cooled interior surface 15, and condenses into water. Some of the steam will condense on food residue on interior surface 15 that was broken down into water soluble components during step 102. As such, the condensed water will dissolve such water soluble components and make such easier to remove from the oven. Again, the length of step 110 will depend upon the size of oven 10, the wattage or power ability of heating element 28, and/or the amount of food residue that needs to be dissolved.

Upon completion of step 112, cavity 14 is again allowed to cool to (or below) a third predetermined temperature, $T_{3rd}$. The cooling of cavity 14 can be allowed to occur by natural conduction and convection or, alternatively, a fan such as the fan used for convection cooking may be used to circulate air through cavity 14 and/or exhaust air to the exterior of oven 10. The third predetermined temperature $T_{3rd}$, is selected so that the temperature of interior surface 15 is safe for the user to wipe or clean in step 118. As indicated in step 114, a processing device can continue to monitor temperature measurements from temperature sensor 38 and allow the oven to cool until the temperature is at $T_{3rd}$. As an alternative to step 114, a timer or time delay could be provided that would allow cavity 14 sufficient time to cool to or below $T_{3rd}$ or temperature appropriate for the user to open door 16.

After reaching $T_{3rd}$, a notification to the user is provided in step 116. This notification signals that door 16 may be opened such that the user can wipe down or otherwise remove the now dissolved food residue from the cavity of oven 10.

The exemplary method of FIG. 3 is provided by way of example only. Using the teachings disclosed herein, one of ordinary skill in the art will understand the other methods may also be used within the spirit and scope of the present invention. For example, in the exemplary embodiment of FIG. 3, valve 34 and pump 36 were not used and, instead, the user manually placed water into recess 30. Thus, valve 34 and pump 36 need not be provided in an oven using the exemplary method of FIG. 3.

Figure 4:
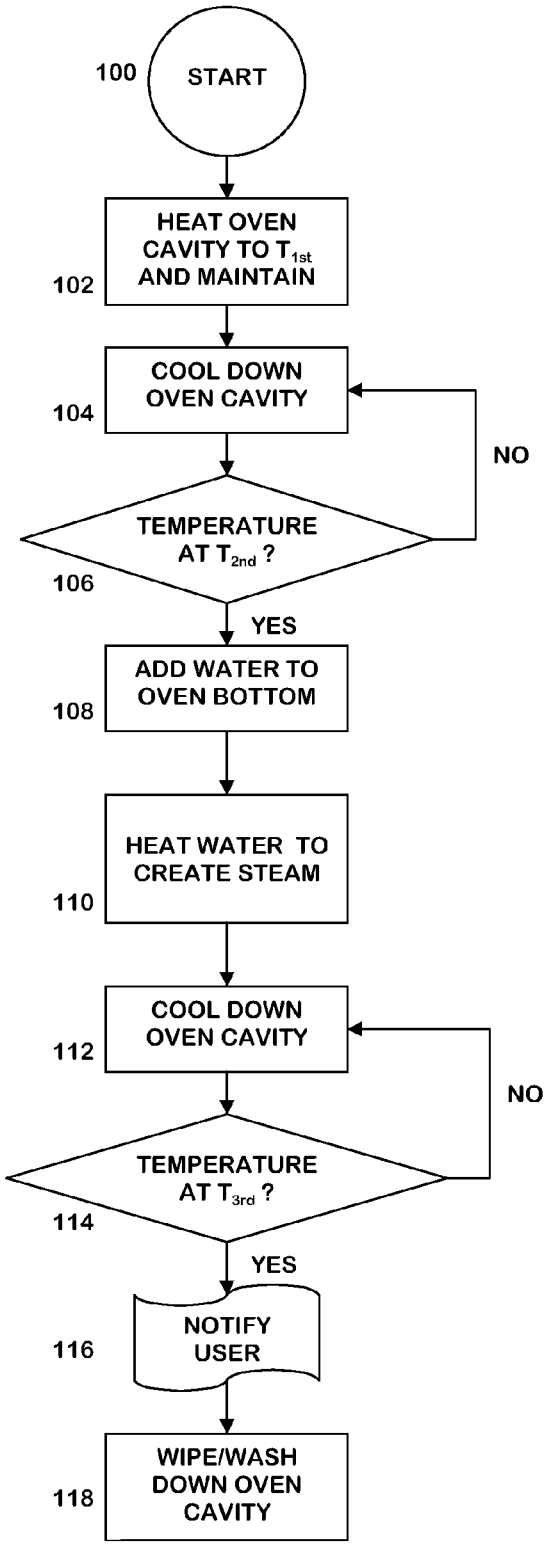

Accordingly, and by way of additional example, FIG. 4 provides another exemplary method of the present invention that also uses a heating cycle and a steam cycle for cleaning oven 10. Steps 100, 102, and 104 operate as previously described for the method of FIG. 3. In step 106, however, once cavity 14 has cooled to or below the second predetermined temperature $T_{2nd}$, the processing device opens valve 34 and/or activates pump 36 so as to feed water into recess 30. As such, the embodiment of FIG. 4 eliminates the manual step of having the user supply water as described with FIG. 3. The remaining steps operate as previously described.

Figure 5:
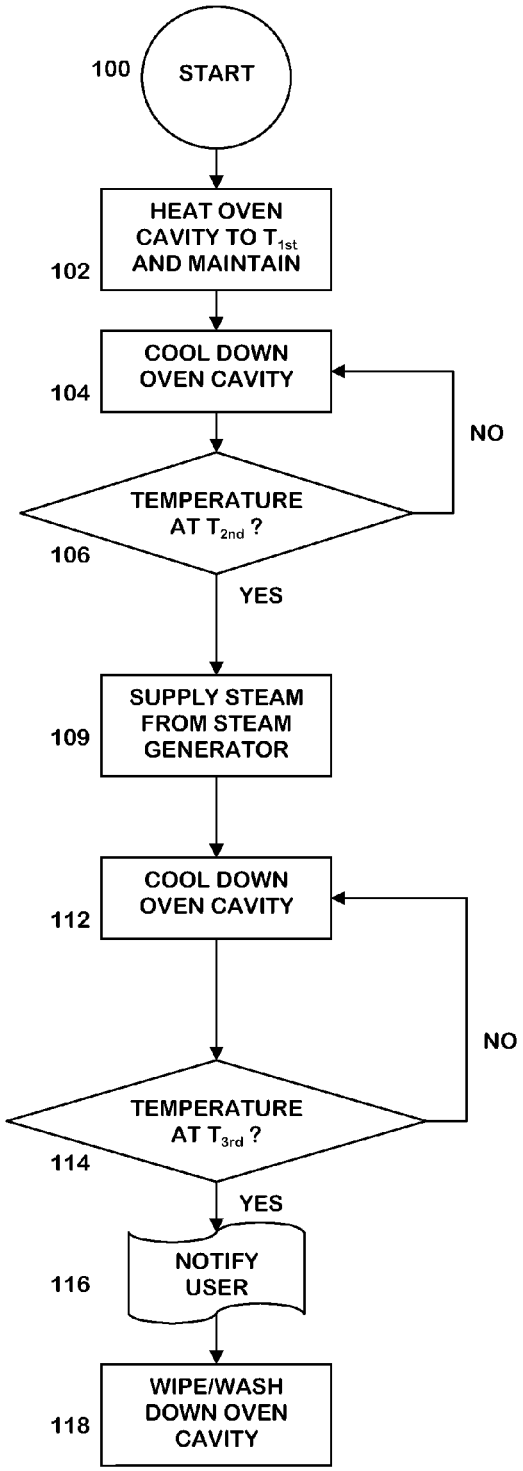

FIG. 5 provides another exemplary method of the present invention in which identically numbered steps operate as previously described with the exemplary method of FIG. 3. However, in step 109, steam is introduced into cavity 14 using a steam generator. More particularly, oven 10 can be equipped with a steam generator that includes e.g., a heating element and reservoir for holding water that is heated to create steam. This steam can then be fed into cavity 14 in step 109 in order to dissolve the water soluble residues as previously described. Such an embodiment for oven 10 may, in certain applications, provide energy efficiencies relative to the use of heating element 28 to heat water in recess 30.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for cleaning an oven appliance, the oven appliance having at least one cavity defined by an interior surface, the method comprising the steps of:

heating the cavity to a first predetermined temperature and for a period of time that is sufficient to break down food residue on the interior surface of the oven;

cooling the oven to a second predetermined temperature;

introducing steam into the cavity of the oven after said step of cooling, and;

providing a notification to the user that the cavity is ready for further treatment.

2. A method for cleaning an oven appliance as in claim 1, further comprising the step of removing food residue from the cavity of the oven by wiping down the interior surface of the oven.

3. A method for cleaning an oven appliance as in claim 1, wherein said step of cooling the oven to a second predetermined temperature comprises creating an air flow through the cavity to assist in cooling.

4. A method for cleaning an oven appliance as in claim 1, wherein said step of cooling the oven to a second predetermined temperature comprises activating a fan to move air through the cavity.

5. A method for cleaning an oven appliance as in claim 1, further comprising the step of sensing the temperature in the cavity before said step of introducing steam.

6. A method for cleaning an oven appliance as in claim 5, further comprising the step of signaling to the user that the oven has cooled after said step of heating.

7. A method for cleaning an oven appliance as in claim 5, wherein said step of introducing steam comprises:

placing water into the cavity of the oven after said step of cooling; and heating the water so as to create steam.

8. A method for cleaning an oven appliance as in claim 7, wherein said step of placing water into the cavity of the oven comprises placing water into a recess located in a bottom of the cavity.

9. A method for cleaning an oven appliance as in claim 1, wherein said step of introducing steam comprises:

activating a valve, a pump, or both in order to move water into the cavity; and heating the water so as to create steam.

10. A method for cleaning an oven appliance as in claim 1, wherein said step of introducing steam comprises:

activating a valve, a pump, or both in order to supply water to a steam generator; and generating steam with said steam generator and feeding the steam into the cavity.

11. A method for cleaning an oven appliance as in claim 1, further comprising the step of sensing the temperature in the oven cavity before said step of providing a notification.

12. A method for cleaning an oven appliance as in claim 11, further comprising the step of determining whether the temperature in the oven cavity is at or below a third predetermined temperature before executing said step of providing a notification.

13. A method for cleaning an oven appliance as in claim 1, further comprising the step of allowing the cavity to cool before executing said step of providing a notification to the user.

14. A method for cleaning an oven appliance as in claim 13, wherein said step of allowing the cavity to cool comprises delaying for a predetermined period of time before executing said step of providing a notification.

15. An oven appliance, comprising;

a cavity defined by an interior surface;

a heating element capable of bringing the interior of the oven to a temperature that is sufficient to break down food residue;

a processing device, said processing device configured to operate the oven by heating the cavity to a first predetermined temperature for a period of time sufficient to break down food residue on the interior surface of the oven;

cooling the oven to a second predetermined temperature;

initiating the introduction of steam into the cavity of the oven after cooling the oven; and, providing a notification to the user that the cavity is ready for further treatment.

16. An oven appliance as in claim 15, further comprising:

a temperature sensor for determining the temperature inside the cavity; and wherein said processing device is further configured to operate the oven by receiving temperature measurements from said temperature sensor; and determining whether the cavity has reached the second predetermined temperature.

17. An oven appliance as in claim 16, wherein said processing device is further configured for receiving temperature measurements from said sensor after said step of introducing steam into the oven; and determining whether the cavity has reached a third predetermined temperature before providing the notification to the user that the cavity is ready for further treatment.

18. An oven appliance as in claim 15, further comprising a recess defined by a bottom of said cavity, said recess configured for the receipt of water for use in creating a steam.

19. An oven appliance as in claim 15, further comprising a steam generator for creating steam to be introduced into said cavity.

20. An oven appliance as in claim 15, further comprising a valve, a pump, or both for introducing water into said cavity.

* * * * *